US011577530B2

(12) United States Patent
Nguyen

(10) Patent No.: US 11,577,530 B2
(45) Date of Patent: Feb. 14, 2023

(54) IMAGE FORMING APPARATUS

(71) Applicant: KYOCERA Document Solutions Inc., Osaka (JP)

(72) Inventor: Danh Chien Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 182 days.

(21) Appl. No.: 17/123,553

(22) Filed: Dec. 16, 2020

(65) Prior Publication Data

US 2021/0187976 A1 Jun. 24, 2021

(30) Foreign Application Priority Data

Dec. 18, 2019 (JP) ..... JP2019-227979

(51) Int. Cl.
*B41J 11/58* (2006.01)
*G03G 15/00* (2006.01)

(52) U.S. Cl.
CPC ..... *B41J 11/58* (2013.01); *G03G 15/6552* (2013.01)

(58) Field of Classification Search
CPC ..... G03G 21/16
See application file for complete search history.

(56) References Cited

U.S. PATENT DOCUMENTS 5,743,522 A * 4/1998 Rubscha ..... B65H 1/04 271/145
6,674,983 B2 * 1/2004 Enomoto ..... G03G 15/6502 399/391
7,407,159 B2 * 8/2008 Tazika ..... B41J 13/103 271/157
8,757,794 B2 * 6/2014 Takemura ..... B65H 29/52 347/108
10,053,310 B2 * 8/2018 Nishiyama ..... B65H 1/266
(Continued)

FOREIGN PATENT DOCUMENTS

JP 2006298625 A 11/2006
JP 2015034080 A * 2/2015

OTHER PUBLICATIONS

Espacenet machine translation of JP2015034080A; http://translationportal.epo.org/emtp/translate/?ACTION=description-retrieval& COUNTRY=JP&ENGINE=google&FORMAT=docdb&KIND=A&LOCALE=en_EP&NUMBER=2015034080&OPS=ops.epo.org/3.2&SRCLANG=ja&TRGLANG=en (Year: 2015).*

*Primary Examiner* — Leslie A Nicholson, III
(74) *Attorney, Agent, or Firm* — Alleman Hall Creasman & Tuttle LLP

(57) ABSTRACT

An image forming apparatus includes a cover portion and an auxiliary tray. The cover portion is displaced between a closing position for closing the supply port and an opening position for opening the supply port. The auxiliary tray is attached to a sheet stack surface of the cover portion, and supports the sheet, together with the cover portion at the opening position. The auxiliary tray is, either in a first attachment state or in a second attachment state, attached to the cover portion. In the first attachment state, a longitudinal direction of the auxiliary tray extends along a width direction that crosses a sheet insertion direction and the auxiliary tray is stored in the sheet stack surface. In the second attachment state, the longitudinal direction extends along the sheet insertion direction, and the auxiliary tray extends out from the cover portion toward an upstream in the sheet insertion direction.

6 Claims, 6 Drawing Sheets

(56) References Cited

U.S. PATENT DOCUMENTS

| | | | | |
|---|---|---|---|---|
| 2002/0061206 | A1* | 5/2002 | Enomoto | G03G 15/6502 399/124 |
| 2022/0106138 | A1* | 4/2022 | Kim | B65H 1/04 |

* cited by examiner

IMAGE FORMING APPARATUS

INCORPORATION BY REFERENCE

This application is based upon and claims the benefit of priority from the corresponding Japanese Patent Application No. 2019-227979 filed on Dec. 18, 2019, the entire contents of which are incorporated herein by reference.

BACKGROUND

The present disclosure relates to an image forming apparatus including a cover portion that opens and closes a sheet supply port and functions as a part of a sheet tray.

There is known an image forming apparatus that includes what is called a manual feed tray. The manual feed tray includes a cover portion that is configured to open and close a sheet supply port formed in a main body housing that stores a print device. The cover portion, in a state where it opens the supply port, functions as a part of a sheet tray on which sheets are placed.

For example, there is known a manual feed tray that is composed of a cover portion and an extension tray that can be pulled out from the cover portion. With the configuration where the extension tray is provided, it is possible to ensure an enough length of the manual feed tray in the sheet insertion direction.

SUMMARY

An image forming apparatus according to an aspect of the present disclosure includes a housing, a cover portion, and an auxiliary tray. The housing stores a print device and has a supply port through which a sheet is supplied. A base end portion of the cover portion is coupled with a lower end portion of the supply port such that the cover portion can be displaced between a closing position for closing the supply port and an opening position for opening the supply port. The cover portion has a sheet stack surface on which the sheet is stacked when the cover portion is at the opening position. The auxiliary tray is attached to the sheet stack surface of the cover portion, and supports the sheet, together with the cover portion at the opening position. The auxiliary tray is, either in a first attachment state or in a second attachment state, attached to the cover portion. When the auxiliary tray is attached to the cover portion in the first attachment state, a longitudinal direction of the auxiliary tray extends along a width direction that crosses a sheet insertion direction and the auxiliary tray is stored in the sheet stack surface of the cover portion. When the auxiliary tray is attached to the cover portion in the second attachment state, the longitudinal direction of the auxiliary tray extends along the sheet insertion direction, and the auxiliary tray extends out from the cover portion toward an upstream in the sheet insertion direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

Figure 1:
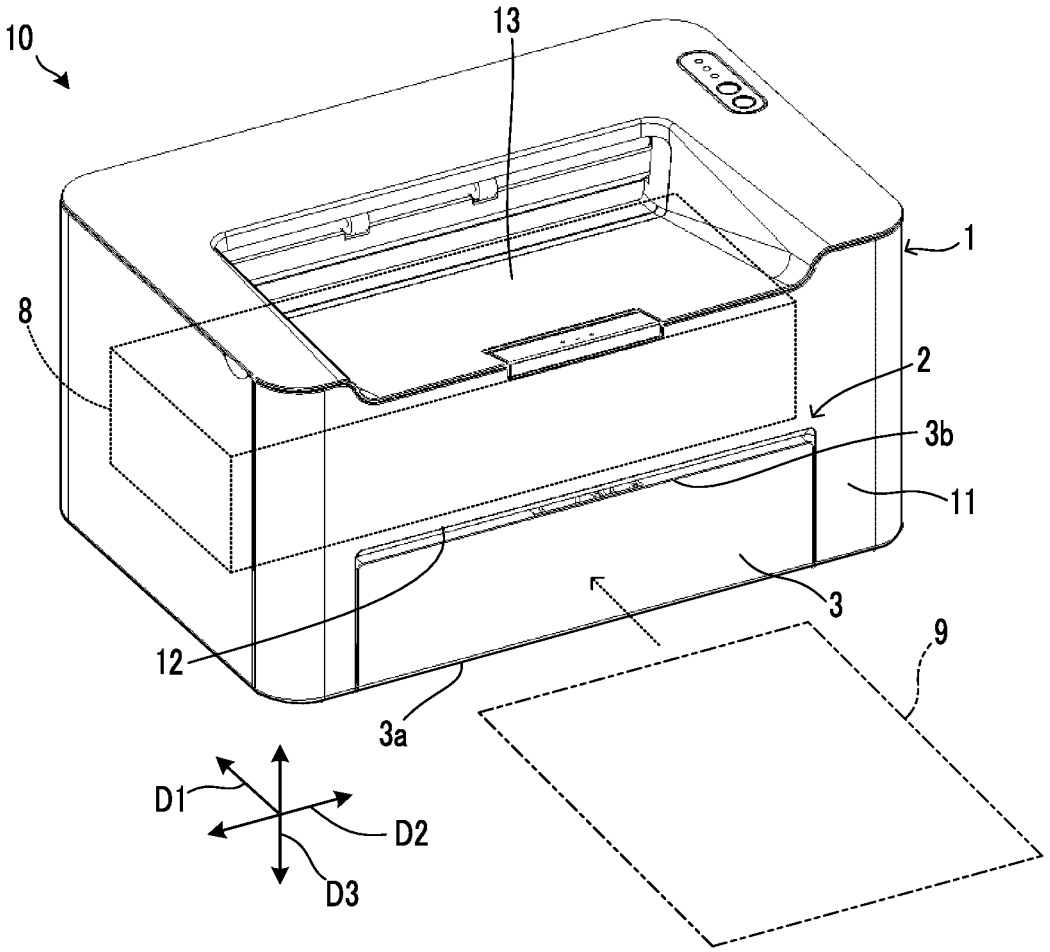
FIG. 1 is a perspective diagram of an image forming apparatus according to an embodiment, showing a state where a cover portion is closed.

As shown in FIG. 1, an image forming apparatus 10 according to an embodiment is, for example, a printer, a copier, a facsimile apparatus, or a multifunction peripheral.

The image forming apparatus 10 includes a print device 8 and a main body housing 1, wherein the print device 8 is configured to execute a print process to form an image on a sheet 9, and the main body housing 1 stores the print device 8. The print device 8 executes the print process by a predetermined method such as an electrophotographic method or an inkjet method.

The main body housing 1 includes a front panel 11 in which is formed a supply port 12 through which the sheet 9 is inserted into the print device 8. The main body housing 1 further includes, on its upper surface, a discharge tray 13 on which is stacked the sheet 9 discharged from the main body housing 1, with an image formed thereon.

The image forming apparatus 10 further includes a manual feed tray 2 that is built in the supply port 12 of the main body housing 1. The main body portion 2 includes a cover portion 3 that covers the supply port 12 of the main body housing 1.

Figure 2:
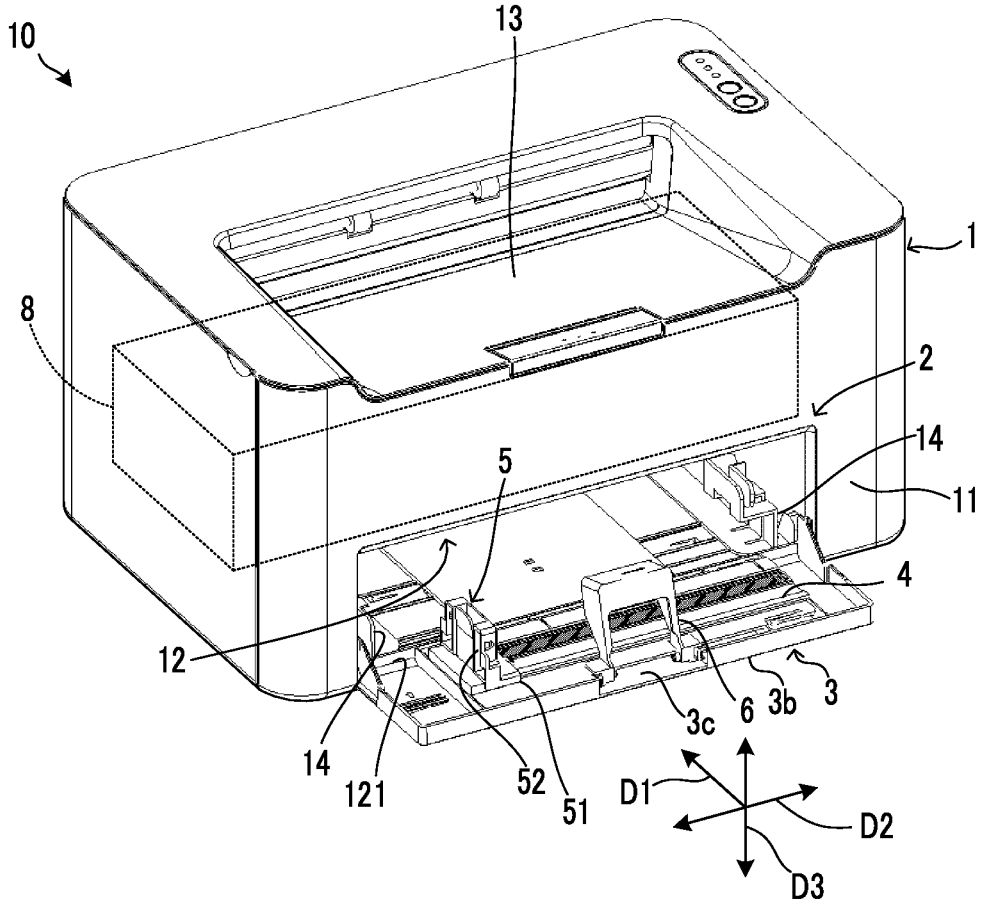
FIG. 2 is a perspective diagram of the image forming apparatus according to the embodiment, showing a state where a cover portion is opened.

As shown in FIG. 1 and FIG. 2, the cover portion 3 is coupled with the main body housing 1 such that the cover portion 3 can be displaced between a closing position for closing the supply port 12 and an opening position for opening the supply port 12. A base end portion 3*a* of the cover portion 3 is coupled with a lower end portion of the supply port 12 of the main body housing 1 (see FIG. 1). Specifically, the cover portion 3 includes a support shaft (not shown) that is rotatably supported by the main body housing 1 such that the cover portion 3 can pivot around the support shaft between the closing position and the opening position.

As shown in FIG. 2, when the cover portion 3 is at the opening position, the cover portion 3 protrudes out the main body housing 1 from a lower end portion 121 of the supply port 12 of the main body housing 1. The cover portion 3 includes a locking portion 31 configured to hold the cover portion 3 at the opening portion by being engaged with a part of the main body housing 1.

Figure 6:
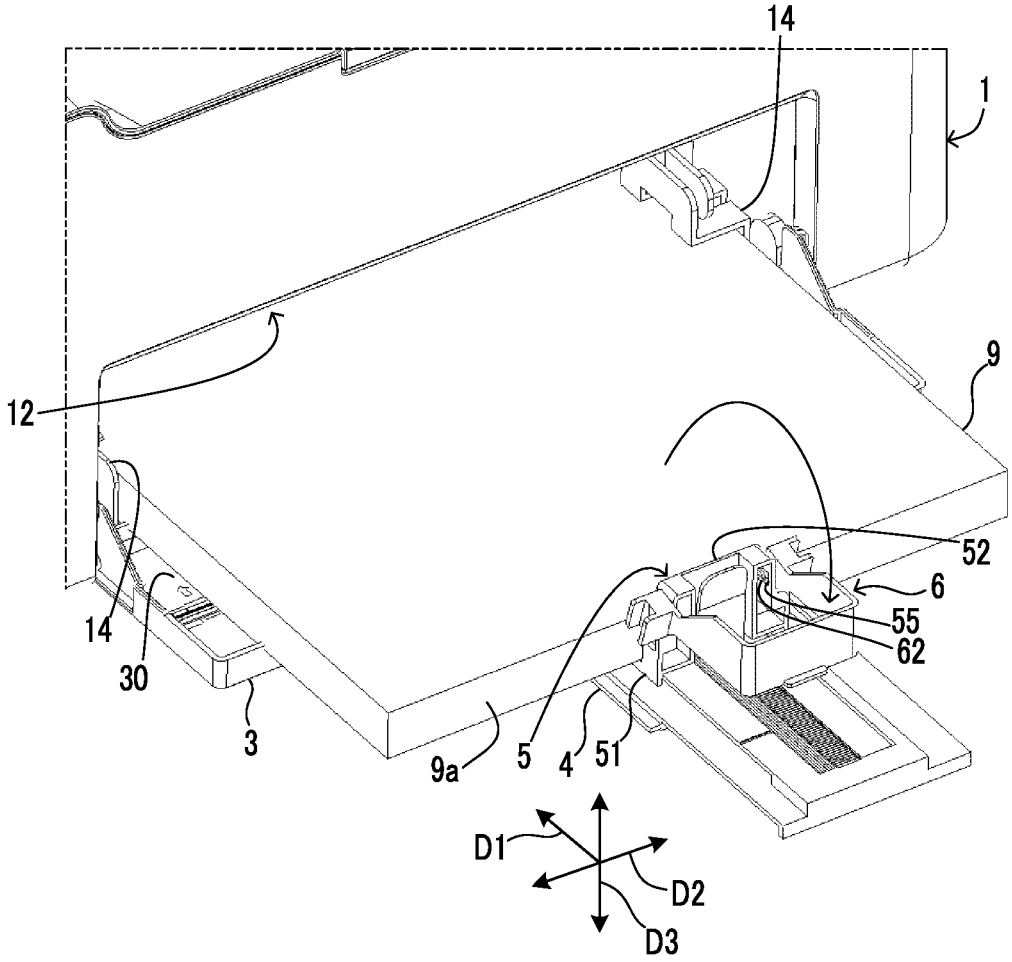
FIG. 6 is a perspective diagram of the manual feed tray including the auxiliary tray in the portrait attachment state in the image forming apparatus according to the embodiment, showing a state where sheets are placed on the manual feed tray.

When the cover portion 3 is at the opening position, the cover portion 3 functions as a part of a sheet tray on which the sheet 9 is placed. As shown in FIG. 6, an inner surface of the cover portion 3 is a sheet stack surface 30 on which the sheet 9 is stacked.

In the following description, a direction in which the sheet 9 placed on the cover portion 3 at the opening position is inserted into the main body housing 1 through the supply port 12, is referred to as a sheet insertion direction D1. In addition, a horizontal direction that crosses the sheet insertion direction D1 is referred to as a width direction D2. In addition, a direction that crosses the width direction D2 and along which the cover portion 3 at the closing position extends, is referred to as a height direction D3. In the present embodiment, the sheet insertion direction D1, the width direction D2, and the height direction D3 are perpendicular to each other.

In addition, a manual feed tray of a conventional type different from the manual feed tray 2 is referred to as a reference manual feed tray. For example, the reference manual feed tray includes the cover portion 3 and one or more extension trays that can be pulled out from the cover portion 3.

Meanwhile, in the reference manual feed tray, when the cover portion 3 is in a closing state, the extension trays need to be stored inside the cover portion 3. As a result, in a case where the cover portion 3 at the closing position is low in height, namely, in a case where the cover portion 3 in an opening state is short in length in the sheet insertion direction D1, a plurality of extension members that are pulled out from the cover portion 3 are required.

However, in a case where the reference manual feed tray includes a plurality of extension members that are pulled out from the cover portion 3, it is difficult to increase the area of an overlapping region where the extension portions overlap with each other, to ensure an enough strength of the reference manual feed tray. Furthermore, in the case where the reference manual feed tray includes a plurality of extension members, the thickness of the whole reference manual feed tray is large when the cover portion 3 is closed.

On the other hand, the manual feed tray 2 of the image forming apparatus 10 has a different configuration from the reference manual feed tray. The following describes the configuration of the manual feed tray 2.

[Configuration of Manual Feed Tray 2]

Figure 3:
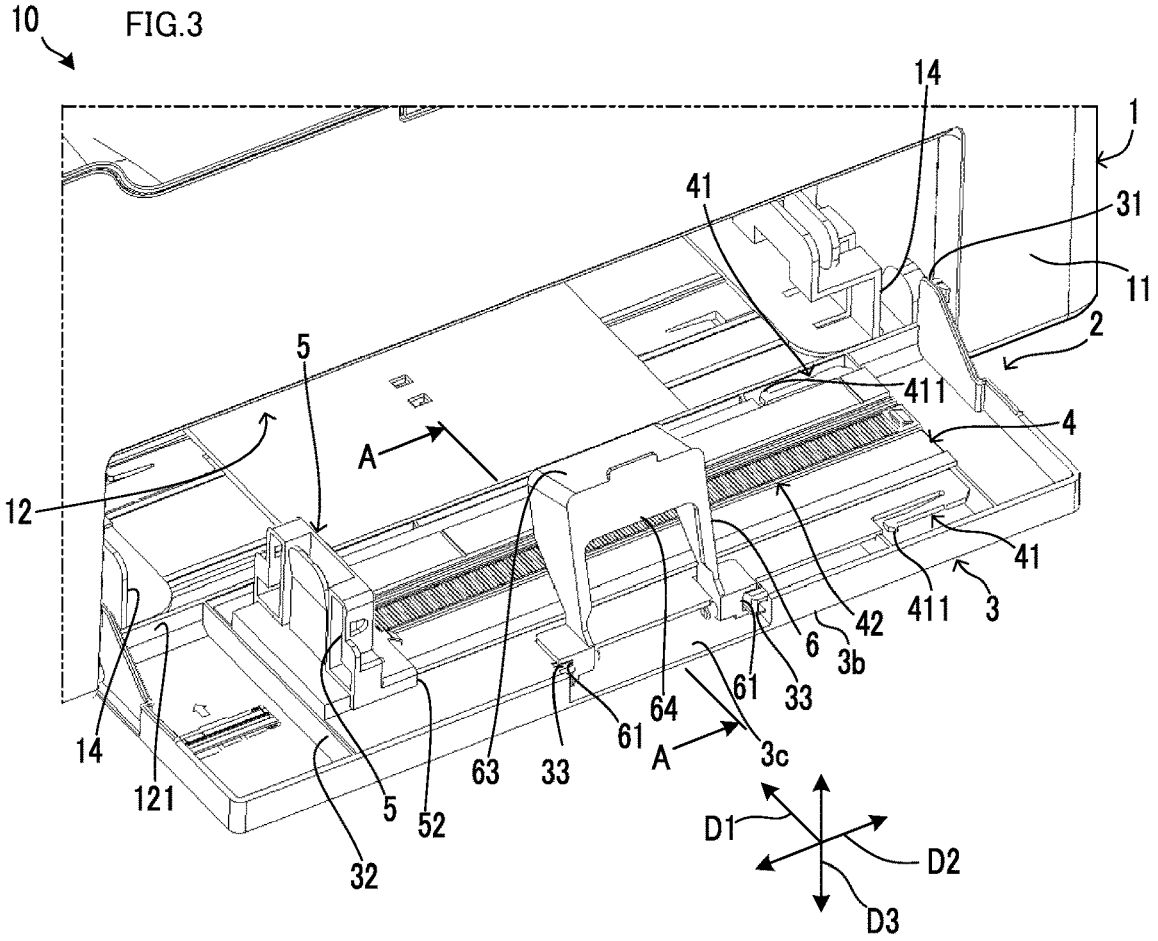
FIG. 3 is a perspective diagram of a manual feed tray including an auxiliary tray in a landscape attachment state in the image forming apparatus according to the embodiment.

As shown in FIG. 2 and FIG. 3, the manual feed tray 2 includes the cover portion 3 and an auxiliary tray 4 that is attached to the inner surface of the cover portion 3.

The auxiliary tray 4 is longer in one direction than in the other directions. As shown in FIG. 2 and FIG. 3, the auxiliary tray 4 is approximately rectangular.

The auxiliary tray 4 is attached to the cover portion 3 when the cover portion 3 is at the opening position. In the attachment state of being attached to the cover portion 3, the auxiliary tray 4 supports the sheet 9 that is fed into the print device 8 via the supply port 12 (see FIG. 6). The auxiliary tray 4, together with the cover portion 3 at the opening position, supports the sheet 9.

The auxiliary tray 4 is attached to the inner surface of the cover portion 3 either in a landscape attachment state or in a portrait attachment state. The landscape attachment state is an example of a first attachment state, and the portrait attachment state is an example of a second attachment state.

Figure 4:
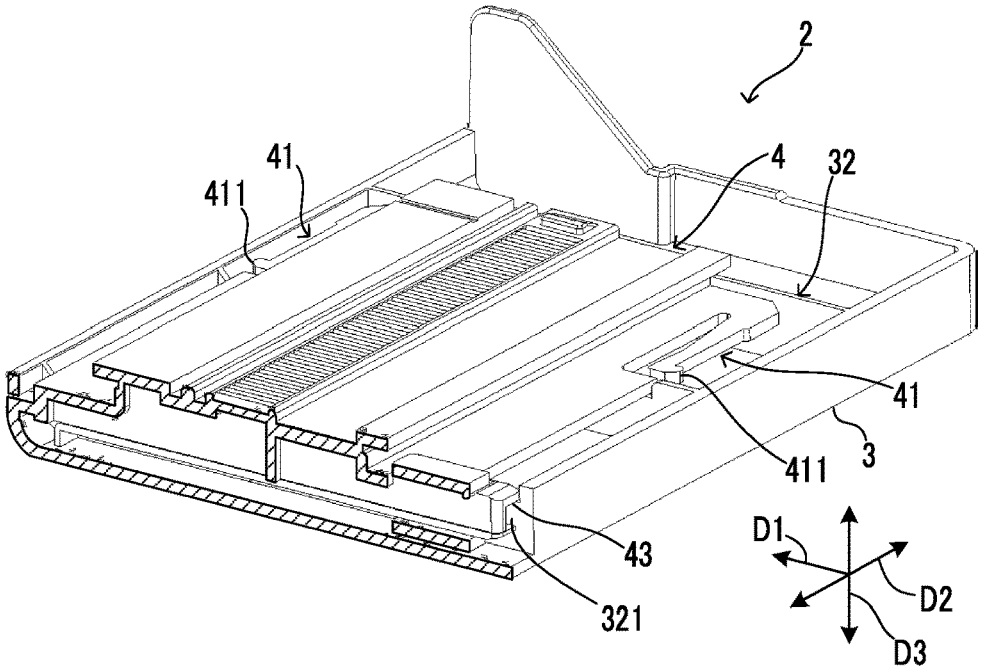
FIG. 4 is a partially cross-sectional perspective diagram of the manual feed tray including the auxiliary tray in the landscape attachment state in the image forming apparatus according to the embodiment.

In the landscape attachment state, the longitudinal direction of the auxiliary tray 4 extends along the width direction D2 and the auxiliary tray 4 is within the inner surface of the cover portion 3. FIG. 2 to FIG. 4 show the manual feed tray 2 including the auxiliary tray 4 in the landscape attachment state. When the auxiliary tray 4 is in the landscape attachment state, the cover portion 3 can be displaced to the closing position.

The cover portion 3 includes a tray attachment portion 32 to which the auxiliary tray 4 is attached in the landscape attachment state (see FIG. 3, FIG. 4). In the example shown in FIG. 4, the auxiliary tray 4 includes a first fitting groove 43, and the tray attachment portion 32 of the cover portion 3 includes a first fitting projection portion 321 that is fitted in the first fitting groove 43.

When the auxiliary tray 4 is placed on the tray attachment portion 32 of the cover portion 3 to extend along the width direction D2, and slid toward one side along the width direction D2, the first fitting projection portion 321 is fitted in the first fitting groove 43. This allows the auxiliary tray 4 to be held by the tray attachment portion 32 of the cover portion 3. In the landscape attachment state, the auxiliary tray 4 is held by the tray attachment portion 32.

On the other hand, when the auxiliary tray 4 in the landscape attachment state is slid toward the other side along the width direction D2, the fitting of the first fitting projection portion 321 and the first fitting groove 43 is released. This allows the auxiliary tray 4 to be removed from the tray attachment portion 32 of the cover portion 3.

Figure 5:
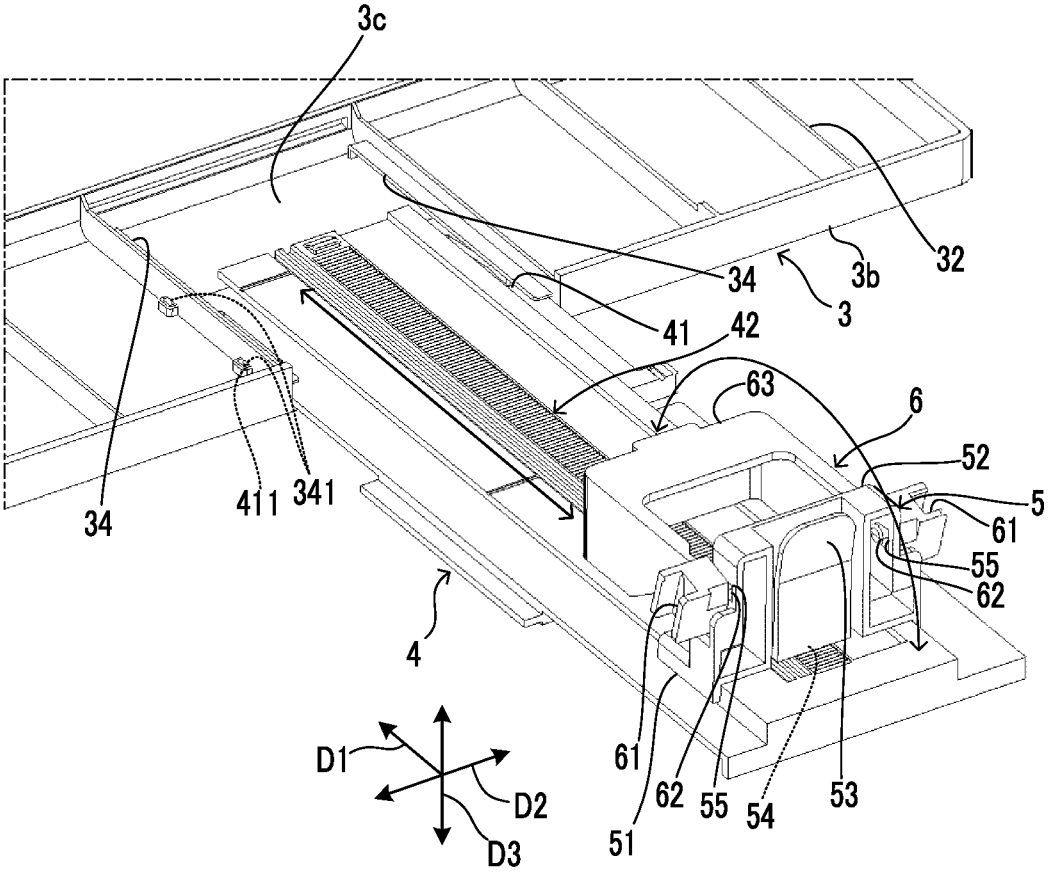
FIG. 5 is a perspective diagram of the manual feed tray including the auxiliary tray in a portrait attachment state in the image forming apparatus according to the embodiment.

In the portrait attachment state, first coupling portions 41 provided at one end of the auxiliary tray 4 in the longitudinal direction of the auxiliary tray 4, are coupled with an attachment portion 3*c* of the inner surface of the cover portion 3, and the other end of the auxiliary tray 4 in the longitudinal direction extends out from the cover portion 3 at the opening position in a direction opposite to the supply port 12. FIG. 5 and FIG. 6 show the manual feed tray 2 including the auxiliary tray 4 in the portrait attachment state.

The attachment portion 3*c* is provided as a recess at the center of an inner surface of a free end portion 3*b* of the cover portion 3 in the width direction D2 (see FIG. 2, FIG. 3, and FIG. 5).

The cover portion 3 includes first coupled portions 34 which the first coupling portions 41 of the auxiliary tray 4 are respectively coupled with. In the present embodiment, the first coupling portions 41 are formed at opposite edges of the auxiliary tray 4 at one end of the auxiliary tray 4 in the longitudinal direction of the auxiliary tray 4.

The first coupled portions 34 of the cover portion 3 have grooves in which the first coupling portions 41 are inserted along the sheet insertion direction D1. The first coupled portions 34 support the first coupling portions 41 inserted in the grooves.

In addition, each of the first coupled portions 34 includes a locking recess portion 341 formed in the groove, and each of the first coupling portions 41 of the auxiliary tray 4 includes a locking claw portion 411 that is fitted in the locking recess portion 341 (see FIG. 4, FIG. 5). The locking claw portion 411 is slightly displaced when the first coupling portion 41 is bent.

When the locking claw portions 411 are fitted in the locking recess portions 341, the locking recess portions 341 hold the auxiliary tray 4 at a predetermined position in the sheet insertion direction D1. However, when a force exceeding a predetermined locking force is applied to the auxiliary tray 4 in the sheet insertion direction D1 or in the opposite direction, the locking claw portions 411 are displaced, and the fitting of the locking claw portions 411 and the locking recess portions 341 is released.

In the example shown in FIG. 5, two locking recess portions 341 are provided at different positions in the sheet insertion direction D1. This allows the first coupled portions 34 to hold the auxiliary tray 4 at two different positions in the sheet insertion direction D1.

The position in the sheet insertion direction D1 at which the auxiliary tray 4 is held is selected from a plurality of options based on the size of the sheet 9.

When a sheet 9 that is short in the sheet insertion direction D1 is used, the auxiliary tray 4 is attached to the cover portion 3 in the landscape attachment state. When a sheet 9 that is long in the sheet insertion direction D1 is used, the auxiliary tray 4 is attached to the cover portion 3 in the portrait attachment state.

In the manual feed tray 2, one auxiliary tray 4 is attached to the cover portion 3 in one of the two attachment states selectively. With this configuration, compared with a case where the cover portion 3 is coupled with two or more extension members at two or more coupling portions, the manual feed tray 2 has a high strength. As a result, the manual feed tray 2 can support the sheet 9 stably regardless of the length of the sheet 9 in the sheet insertion direction D1.

In addition, since only one auxiliary tray 4 is attached to the cover portion 3, the manual feed tray 2 does not have a large thickness.

In addition, when the cover portion 3 is closed, the auxiliary tray 4 is attached to the cover portion 3 in the landscape attachment state. With this configuration, a long auxiliary tray 4 corresponding to the size of the cover portion 3 in the width direction D2 can be stored inside the cover portion 3.

Accordingly, even when the cover portion 3 at the closing position has a large length in the height direction D3, namely, even when the cover portion 3 at the opening position has a small length in the sheet insertion direction D1, it is possible to ensure the length and strength of the sheet tray that is composed of the cover portion 3 and the auxiliary tray 4.

The manual feed tray 2 further includes a main end guide 5 that is coupled with the auxiliary tray 4. The main end guide 5 is coupled with the auxiliary tray 4 so as to be slidable in the longitudinal direction of the auxiliary tray 4, and stands up from the auxiliary tray 4. The main end guide 5 is an example of a first end guide.

The main end guide 5 includes a slide coupling portion 51 and a standing portion 52, wherein the slide coupling portion 51 is slidably coupled with the auxiliary tray 4, and the standing portion 52 stands up from the slide coupling portion 51.

As shown in FIG. 6, the standing portion 52 of the main end guide 5 is disposed to face a rear end 9*a* of the sheet 9 placed on the auxiliary tray 4 in the portrait attachment state.

In the state where the standing portion 52 abuts on the rear end 9*a* of the sheet 9 placed on the auxiliary tray 4, the main end guide 5 is pressed in the sheet insertion direction D1 until it reaches a position corresponding to the size of the sheet 9. This allows the main end guide 5 to guide the sheet 9 on the auxiliary tray 4 to a correct position in the sheet insertion direction D1. Furthermore, when the main end guide 5 abuts on the rear end 9*a* of the sheet 9, the main end guide 5 restricts movement of the sheet 9 in a direction opposite to the sheet insertion direction D1.

Figure 7:
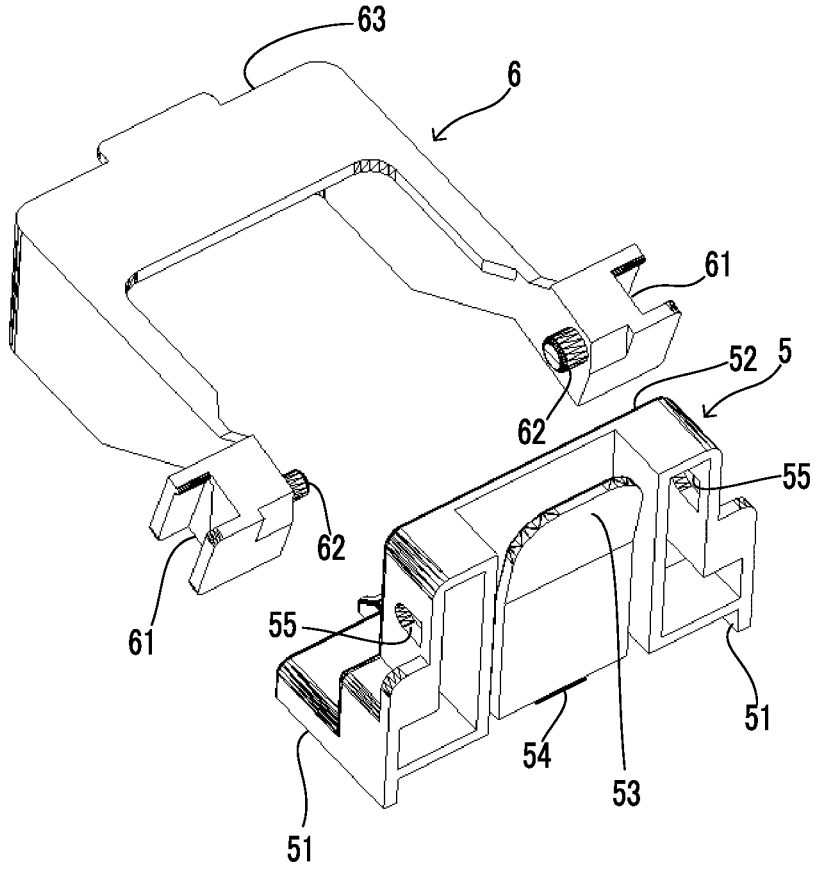
FIG. 7 is a broken perspective diagram of a main end guide and an auxiliary end guide in the image forming apparatus according to the embodiment.

In addition, as shown in FIG. 5 and FIG. 7, the auxiliary tray 4 includes a rack gear 42 formed along the longitudinal direction of the auxiliary tray 4. Furthermore, the main end guide 5 includes a lever 53 and an engaging claw 54.

The lever 53 is configured to swing in accordance with an operation by the user. The engaging claw 54 is displaced vertically in conjunction with the swinging of the lever 53. The lever 53 is biased by a spring (not shown) in a direction such that the engaging claw 54 is displaced downward.

The engaging claw 54 is displaced, in conjunction with the swinging of the lever 53, between a lower position where it is engaged with the rack gear 42 and an upper position where it is separated from the rack gear 42.

The user operates the lever 53 to move the main end guide 5 to a target position in the sheet insertion direction D1, and stops operating the lever 53. This allows the engaging claw 54 to be engaged with the rack gear 42, and the main end guide 5 is held at the target position.

The manual feed tray 2 further includes an auxiliary end guide 6 that is coupled with either the main end guide 5 or the cover portion 3 selectively. That is, the auxiliary end guide 6 can be attached to the main end guide 5 in a detachable manner, and can be attached to the inner surface of the cover portion 3 in a detachable manner. That is, the auxiliary end guide 6 can be attached to and detached from the main end guide 5 or the attachment portion 3*c* of the cover portion 3. It is noted that the auxiliary end guide 6 is an example of a second end guide.

When the cover portion 3 is closed, or when the auxiliary tray 4 is attached to the cover portion 3 in the landscape attachment state, the auxiliary end guide 6 is attached to the attachment portion 3*c* of the cover portion 3 (see FIG. 2, FIG. 3). The auxiliary end guide 6 is fixed to the cover portion 3 by being attached to the attachment portion 3*c* of the cover portion 3.

In addition, when the auxiliary tray 4 is attached to the cover portion 3 in the portrait attachment state, the auxiliary end guide 6 is attached to the main end guide 5 (see FIG. 5, FIG. 6).

As shown in FIG. 3, the auxiliary end guide 6 includes second coupling portions 61 that are attached to the cover portion 3. The cover portion 3 includes second coupled portions 33 to which the second coupling portions 61 of the auxiliary end guide 6 are attached.

In the example shown in FIG. 3, the second coupling portions 61 have grooves, and the second coupled portions 33 are projections that are fitted in the grooves of the second coupling portions 61.

When the auxiliary end guide 6 is slid in the sheet insertion direction D1 at a predetermined position with respect to the cover portion 3, the second coupled portions 33 that are projections are fitted in the grooves of the second coupling portions 61. This allows the auxiliary end guide 6 to be fixed to the second coupled portion 33 of the cover portion 3.

The auxiliary end guide 6 includes a cover lock portion 64 that holds the cover portion 3 at the closing position by being engaged with a part of the main body housing 1 when the cover portion 3 is displaced to the closing position while the auxiliary end guide 6 is coupled with the cover portion 3.

That is, the auxiliary end guide 6 also serves as a lock member to hold the cover portion 3 at the closing position. It is noted that when the cover portion 3 at the closing position is pulled toward the opening position by a certain force, the auxiliary end guide 6 is bent, and the lock by the cover lock portion 64 is released.

On the other hand, when the auxiliary end guide 6 attached to the cover portion 3 is slid in a direction opposite to the sheet insertion direction D1, the fitting of the second coupled portions 33 and the second coupling portions 61 is released. This allows the auxiliary end guide 6 to be removed from the second coupled portions 33 of the cover portion 3.

In addition, the auxiliary end guide 6 is coupled with the main end guide 5 in such a way as to be displaced between a use position and a retracted position. FIG. 5 shows the auxiliary end guide 6 at the use position, and FIG. 6 shows the auxiliary end guide 6 at the retracted position.

The use position is located downstream of the main end guide 5 in the sheet insertion direction D1. At the use position, the auxiliary end guide 6 extends out from the main end guide 5 toward the first coupling portions 41 of the auxiliary tray 4. The retracted position is located upstream of the main end guide 5 in the sheet insertion direction D1.

The auxiliary end guide 6 at the use position faces the rear end 9*a* of the sheet 9 placed on the auxiliary tray 4 in the portrait attachment state. At this time, the guide surface 63 of the auxiliary end guide 6 faces the rear end 9*a* of the sheet 9.

In a state where the auxiliary end guide 6 is located at the use position, and the guide surface 63 of the auxiliary end guide 6 abuts on the rear end 9*a* of the sheet 9 on the auxiliary tray 4, the main end guide 5 is pressed in the sheet insertion direction D1 until it reaches a position corresponding to the size of the sheet 9. This allows the auxiliary end guide 6 to guide the sheet 9 on the auxiliary tray 4 to a correct position in the sheet insertion direction D1.

When the auxiliary end guide 6 is located at the retracted position, the main end guide 5 is arranged to face the rear end 9*a* of the sheet 9 on the auxiliary tray 4 in the portrait attachment state (see FIG. 6).

Here, the sheet 9 that is restricted from moving by the main end guide 5 is referred to as a first sheet. When the auxiliary end guide 6 is located at the retracted position, the main end guide 5 is arranged to face the rear end of the first sheet, and thereby restricts movement of the first sheet.

On the other hand, when the auxiliary end guide 6 is located at the use position, the auxiliary end guide 6 is arranged to face the rear end of a second sheet that is smaller than the first sheet, and thereby restricts movement of the second sheet in a direction opposite to the sheet insertion direction D1.

As shown in FIG. 7, the auxiliary end guide 6 includes two third coupling portions 62 each having the shape of a projected shaft. On the other hand, the main end guide 5 includes two third coupled portions 55 having holes in which the third coupling portions 62 are fitted. The two third coupling portions 62 are coaxially arranged.

When the two projecting third coupling portions 62 are fitted in the two third coupled portions 55, the auxiliary end guide 6 is supported by the main end guide 5 in such a way as to pivot around the two third coupling portions 62.

The auxiliary end guide 6 is pivoted with respect to the main end guide 5 so as to be displaced from one of the use position and the retracted position to the other.

In the example shown in FIG. 7, the two third coupling portions 62 are formed in the shape of cylinders of different diameters. In correspondence with this, the two third coupled portions 55 have holes of different inner diameters. This prevents the auxiliary end guide 6 from being coupled with the main end guide 5 in a wrong orientation.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a housing storing a print device and having a supply port through which a sheet is supplied;

a cover portion whose base end portion is coupled with a lower end portion of the supply port such that the cover portion can be displaced between a closing position for closing the supply port and an opening position for opening the supply port, the cover portion having a sheet stack surface on which the sheet is stacked when the cover portion is at the opening position; and an auxiliary tray attached to the sheet stack surface of the cover portion, the auxiliary tray supporting the sheet, together with the cover portion at the opening position, wherein the auxiliary tray is, either in a first attachment state or in a second attachment state, attached to the cover portion, wherein when the auxiliary tray is attached to the cover portion in the first attachment state, a longitudinal direction of the auxiliary tray extends along a width direction that crosses a sheet insertion direction and the auxiliary tray is stored on the sheet stack surface of the cover portion, and when the auxiliary tray is attached to the cover portion in the second attachment state, the longitudinal direction of the auxiliary tray extends along the sheet insertion direction, and the auxiliary tray extends out from the cover portion toward an upstream in the sheet insertion direction, the auxiliary tray includes a first end guide that stands up from the auxiliary tray and is slidable in the longitudinal direction of the auxiliary tray, and the first end guide is disposed to face a rear end of the sheet placed on the auxiliary tray in the second attachment state and restricts movement of the sheet by abutting on the sheet.

2. The image forming apparatus according to claim 1, further comprising:

a second end guide that is coupled with the first end guide in the second attachment state in such a way as to be displaced between a use position and a retracted position, the use position being located downstream of the first end guide in the sheet insertion direction, the retracted position being located upstream of the first end guide in the sheet insertion direction, wherein when the second end guide is located at the retracted position, the first end guide faces a rear end of a first sheet, and thereby restricts movement of the first sheet, and when the second end guide is located at the use position, the second end guide faces a rear end of a second sheet that is smaller than the first sheet, and thereby restricts movement of the second sheet.

3. The image forming apparatus according to claim 2, wherein the second end guide includes a cover lock portion that holds the cover portion at the closing position by being engaged with a part of the housing when the cover portion is at the closing position while the auxiliary tray is attached to the cover portion in the first attachment state.

4. The image forming apparatus according to claim 3, wherein the cover portion includes an attachment portion to which the second end guide is attached, the attachment portion is provided as a recess at a center, in the width direction, of a free end portion of the cover portion.

5. The image forming apparatus according to claim 1, wherein the cover portion can be displaced to the closing position with the auxiliary tray attached on the cover portion in the first attachment state.

6. An image forming apparatus comprising:

a housing storing a print device and having a supply port through which a sheet is supplied;

a cover portion whose base end portion is coupled with a lower end portion of the supply port such that the cover portion can be displaced between a closing position for closing the supply port and an opening position for opening the supply port, the cover portion having a sheet stack surface on which the sheet is stacked when the cover portion is at the opening position; and an auxiliary tray attached to the sheet stack surface of the cover portion, the auxiliary tray supporting the sheet, together with the cover portion at the opening position, wherein the auxiliary tray is, either in a first attachment state or in a second attachment state, attached to the cover portion, wherein when the auxiliary tray is attached to the cover portion in the first attachment state, the auxiliary tray is stored on the sheet stack surface of the cover portion, and when the auxiliary tray is attached to the cover portion in the second attachment state, a longitudinal direction of the auxiliary tray extends along a sheet insertion direction, and the auxiliary tray extends out from the cover portion toward an upstream in the sheet insertion direction, the auxiliary tray includes a first end guide that stands up from the auxiliary tray and is slidable in the longitudinal direction of the auxiliary tray, and the first end guide is disposed to face a rear end of the sheet placed on the auxiliary tray in the second attachment state and restricts movement of the sheet by abutting on the sheet.

* * * * *